US007110015B2

(12) United States Patent
Chou

(10) Patent No.: US 7,110,015 B2
(45) Date of Patent: Sep. 19, 2006

(54) THERMAL PRINTING DEVICE AND METHODS FOR MANUFACTURING THE SAME

(75) Inventor: Bruce C. S. Chou, Hsin Chu (TW)

(73) Assignee: LighTuning Tech. Inc., Hsinchu (TW)

( * ) Notice: Subject to any disclaimer, the term of this patent is extended or adjusted under 35 U.S.C. 154(b) by 295 days.

(21) Appl. No.: 10/807,282

(22) Filed: Mar. 24, 2004

(65) Prior Publication Data

US 2005/0212859 A1 Sep. 29, 2005

(51) Int. Cl.
*B41J 2/335* (2006.01)

(52) U.S. Cl. ..... 347/200; 347/206; 347/205

(58) Field of Classification Search ..... 347/200, 347/206, 208

See application file for complete search history.

(56) References Cited

FOREIGN PATENT DOCUMENTS

| | | |
|---|---|---|
| EP | 1247653 | * 10/2002 |
| JP | 61-283570 | * 12/1986 |

* cited by examiner

*Primary Examiner*—Huan Tran
(74) *Attorney, Agent, or Firm*—Birch, Stewart, Kolasch & Birch, LLP

(57) ABSTRACT

A thermal printing device includes a substrate, an insulation layer on the substrate, and a plurality of microheaters on the insulation layer. Two adjacent ones of the microheaters are separated by a trench. Each of the microheaters includes a body having a heating surface, and two metal wires disposed on two sides of the heating surface of the body. A thermal printing operation is performed by applying a variable voltage or current between the two metal wires in order to heat the microheater to a predetermined temperature.

17 Claims, 4 Drawing Sheets

THERMAL PRINTING DEVICE AND METHODS FOR MANUFACTURING THE SAME

BACKGROUND OF THE INVENTION

1. Field of the Invention

The invention relates to a thermal printing device, and more particularly to a thermal printing device formed by the micromachining technology and applied to the printing market owing to its low power consumption and high resolution. This invention also relates to Taiwan Patent Application No. 092119508, filed on Jul. 17, 2003, and entitled "Ink-Jet Print Head With A Chamber Sidewall Heating Mechanism And A Method For Manufacturing The Same".

2. Description of the Related Art

A conventional thermal printing head (TPH) prints texts or images on a sheet by way of thermal transfer printing technology using dyes on a black or color ribbon. Unlike the printing technology of the ink-jet print head, the thermal printing device may provide excellent gray-scale effects by controlling the temperature of transfer printing, and may provide the quality approximating the conventional photo printing quality in the aspect of color photo printing.

FIG. 1 is a cross-sectional view showing a conventional thermal printing device. Referring to FIG. 1, the conventional thermal printing device includes a substrate 10, a heat-isolation layer 12, a plurality of heating resistors 14, and a passivation layer 16. The substrate 10 is typically a ceramic substrate having good thermal conductivity. The heat-isolation layer 12, which is composed of, for example, a silicon dioxide material with poor thermal conductivity, is formed on the substrate 10 so that the thermal efficiency of the thermal printing device may be enhanced. The heating resistors 14 are formed on the heat-isolation layer 12, and the passivation layer 16 with the wear-resistant property and the good thermal conductivity is formed on the heating resistors 14 and the heat-isolation layer 12.

However, the conventional thermal printing device still has the drawback of great power consumption owing to the solid heat conductance and thus the drawback of poor heating efficiency. Moreover, the thermal coupling problems between different heating resistors 14 may limit the resolution. Thus, the thermal printing device with high resolution (the current technology may only reach 300 to 400 dpi) cannot be manufactured, and the quality of the printed color photo may be simultaneously limited. On the other hand, the conventional manufacture technology also limits the possibility of integrating the TPH and its corresponding circuits into a single chip.

Accordingly, the invention wishes to provide a micromachined thermal printing device to overcome the conventional problems and drawbacks.

SUMMARY OF THE INVENTION

It is therefore an object of the invention to provide a thermal printing device and methods for manufacturing the same, wherein the structure of the thermal printing device is formed by micromachining a SOI (Silicon on insulator) wafer 40. Thus, the thermal loss caused by the solid heat conductance may be effectively reduced, and the effects of low power consumption and high heating efficiency may be obtained.

Another object of the invention is to improve the heat-isolation effects between the microheaters of the thermal printing device and to shorten the pitch between the microheaters below 40 microns. Thus, the conventional problems of thermal coupling between heating resistors may be overcome, and thus a high-resolution printing device having the resolution greater than 600 dpi may be provided.

Still another object of the invention is to integrate the thermal printing device with associated circuits on a single chip by way of the micromachining technology, and thus to simplify the manufacturing processes and miniaturize the size of the thermal printing device.

The invention achieves the above-mentioned objects by providing a thermal printing device including a substrate, an insulation layer on the substrate, and a plurality of microheaters on the insulation layer. Two adjacent ones of the microheaters are separated by a trench. Each of the microheaters includes a body having a heating surface, and two metal wires disposed on two sides of the heating surface of the body. A thermal printing operation is performed by applying a variable voltage or current between the two metal wires in order to heat the microheater to a predetermined temperature.

The invention also achieves the above-mentioned objects by providing a thermal printing device including a substrate formed with a plurality of grooves, a plurality of microheaters respectively arranged in the grooves and suspended above the substrate, and a covering structure formed on the substrate to cover the microheaters with gaps left between the microheaters and the covering structure.

Thus, the thermal printing device of the invention may effectively reduce the thermal loss caused by the solid heat conductance between the microheaters and between each microheater and the substrate, and thus have the effects of low power consumption and high resolution.

Other objects, features, and advantages of the invention will become apparent from the following detailed description of the preferred but non-limiting embodiment. The following description is made with reference to the accompanying drawing.

DETAILED DESCRIPTION OF THE INVENTION

Figure 1:
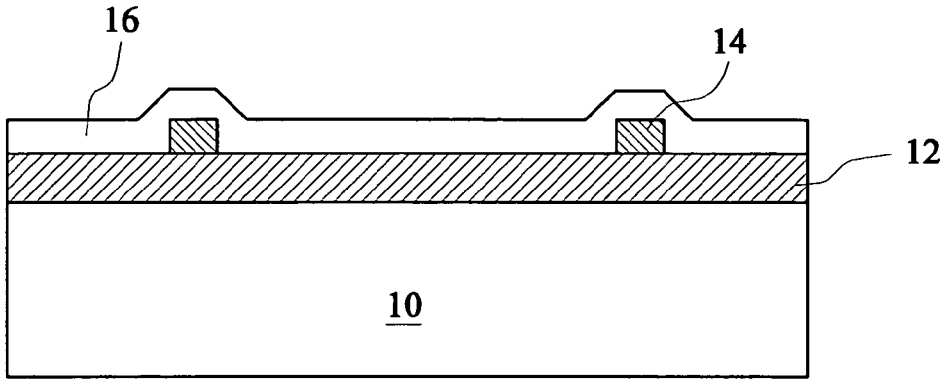
FIG. 1 (Prior Art)
FIG. 1 is a cross-sectional view showing a conventional thermal printing device.
Figure 2:
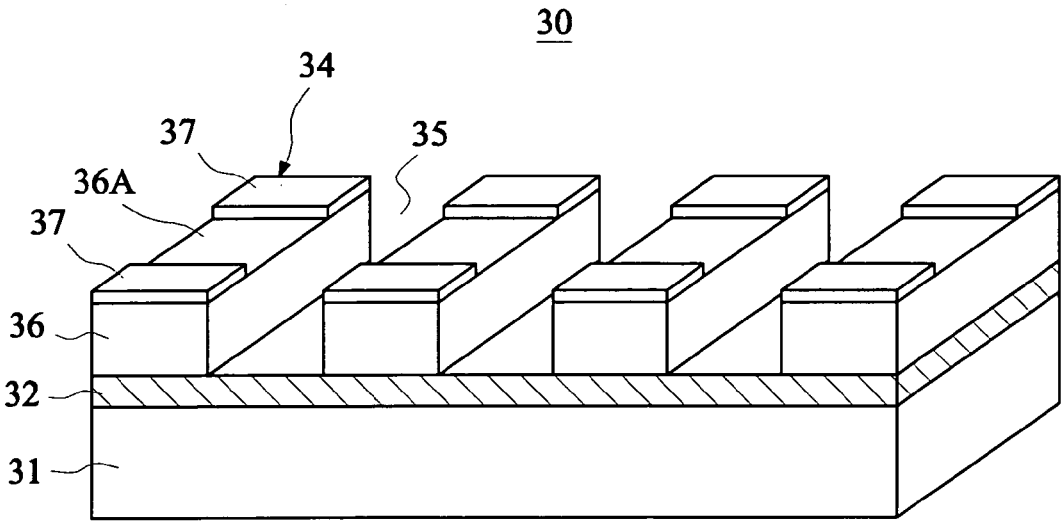
FIG. 2 is a pictorial view showing a thermal printing device according to a first embodiment of the invention.

FIG. 2 is a pictorial view showing a thermal printing device according to a first embodiment of the invention. Referring to FIG. 2, the thermal printing device 30 of the first embodiment includes a substrate 31, an insulation layer 32 on the substrate 31, and a plurality of microheaters 34 on the insulation layer 32. The insulation layer 32 is made of, for example, a silicon dioxide. Two adjacent ones of the microheaters 34 are separated by a trench 35. Each microheater 34 includes a body 36 having a heating surface 36A, and two metal wires 37 disposed on two sides of the heating surface 36A of the body 36. The thickness of the body 36 is greater than 10 microns, and the preferred thickness thereof ranges from 20 to 30 microns. The body 36 and the substrate 31 are made of the monocrystalline silicon. The two metal wires 37 are located at two sides of the heating surface 36A of the body 36. In practice, a thermal printing operation is performed by applying a variable voltage or current between the two metal wires 37 in order to generate heat through the heating surface 36A.

Figure 3:
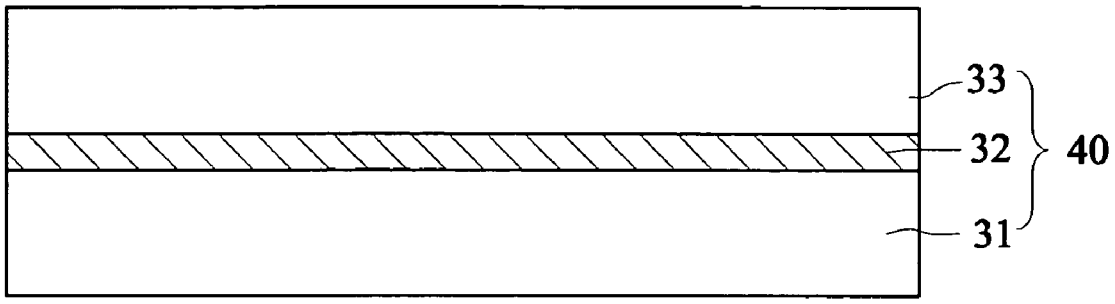
FIGS. 3 to 5 are cross-sectional views showing the steps of manufacturing the thermal printing device of the invention.
Figure 4:
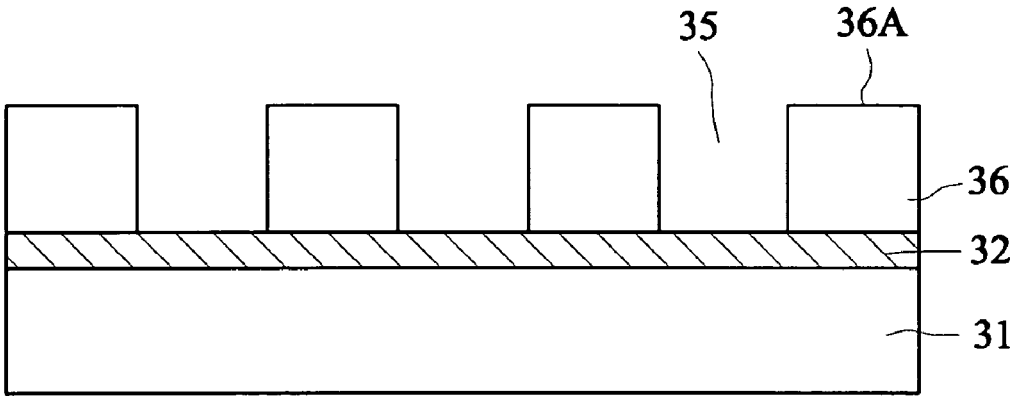
Figure 5:
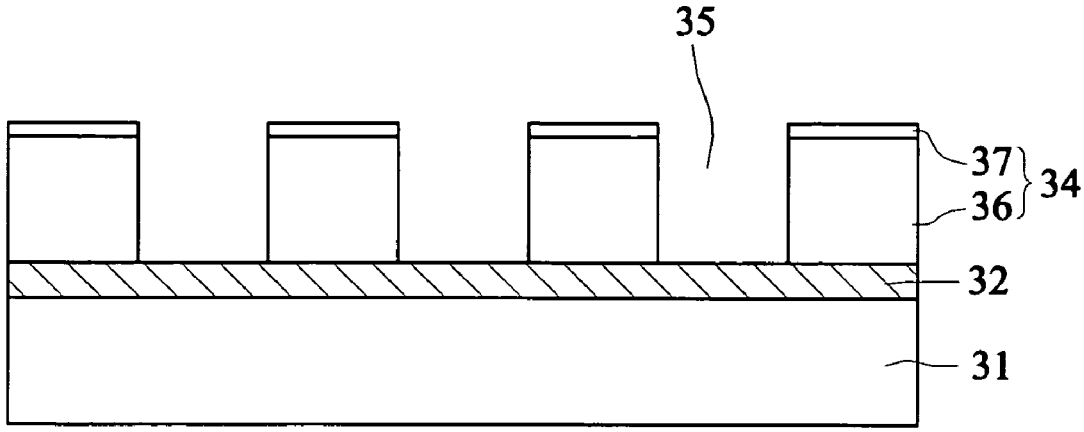

FIGS. 3 to 5 are cross-sectional views showing the steps of manufacturing the thermal printing device of the invention. Referring to FIGS. 3 to 5, the method for manufacturing a thermal printing device includes the following steps.

First, a SOI (Silicon on insulator) wafer 40 having a sandwich structure is provided. The SOI wafer 40 is composed of, from bottom to top, a first silicon layer 31, an insulation layer 32, and a second silicon layer 33. Then, a portion of the second silicon layer 33 is removed to form a plurality of trenches 35 and expose a portion of the insulation layer 32 by way of ICP (Inductively Coupled Plasma, also referred to as the deep silicon etch) etching technology. The second silicon layer 33 is formed into a plurality of bodies 36 of a plurality of microheaters 34 on the insulation layer 32, and each of the bodies 36 has a heating surface 36A. Thereafter, two metal wires 37 of each of the microheaters 34 are formed on two sides of the heating surface 36A of each of the bodies 36.

Figure 6:
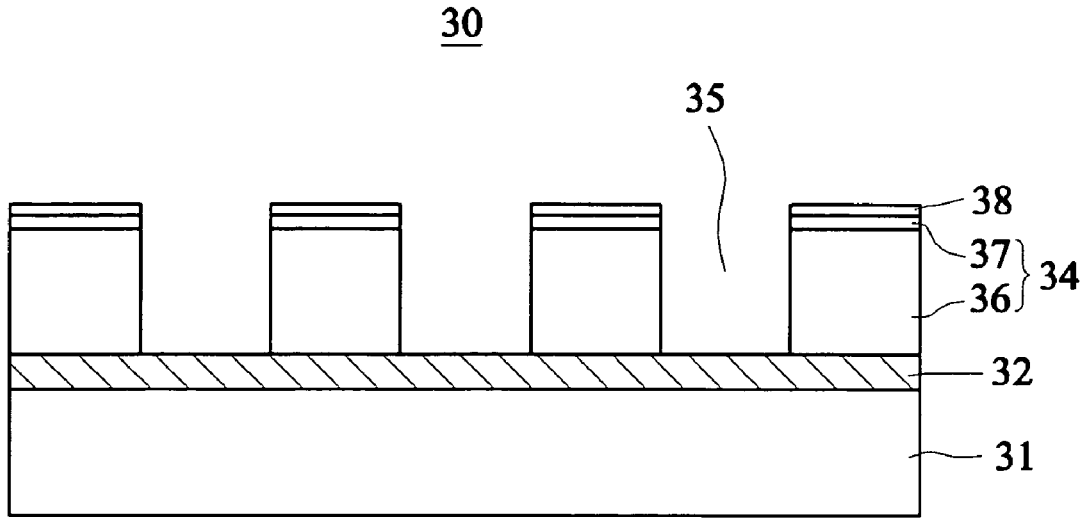
FIG. 6 is a pictorial view showing a thermal printing device according to a second embodiment of the invention.

FIG. 6 is a pictorial view showing a thermal printing device according to a second embodiment of the invention. As shown in FIG. 6, this embodiment is similar to that of the first embodiment but different from the first embodiment in that the thermal printing device 30 of the second embodiment further includes a hard coating 38 covering over the microheaters 34 to protect the metal wires 37 and the heating surfaces 36A.

When the thermal printing device 30 of the invention is used, the heat produced by the heating surface 36A is mainly transferred to the print medium, such as a ribbon or a thermal printing sheet, so as to produce a thermal printing point because the resistance of each metal wire 37 is far smaller than that of the heating surface 36A. Because the solid heat conductance of silicon is much larger than that of the silicon dioxide and the adjacent microheaters 34 are spaced by a trench 35, the heat produced by each microheater 34 cannot be easily transferred in the leftward, rightward, and downward directions, and the thermal loss may be reduced. Therefore, the temperature of the microheater 34 may be increased above 100 Celsius degrees with only a few milliwatts (mW), and the effects of low power consumption and high heating efficiency may be obtained. In addition, because the adjacent microheaters 34 are well thermally insolated, the pitch P between the adjacent microheaters 34 may be made smaller than 40 microns, the resolution as high as 600 dpi can be obtained, and the problem of cross-talk can be avoided, all of which cannot be achieved in the prior art.

On the other hand, using the SOI wafer and the micromachining technology to manufacture the thermal printing device makes it easy to integrate associated circuits on a single chip. Thus, the thermal printing device may be simply manufactured and the size thereof may be reduced. That is, the microheaters, trenches, and associated ICs such as control circuits may be formed on a SOI wafer using the commercial manufacturing processes that have been existed in the typical IC foundry, and the ICP process is completely compatible with that in the IC foundry. Therefore, the thermal printing device of the invention may be manufactured in a low-cost manner.

Figure 7:
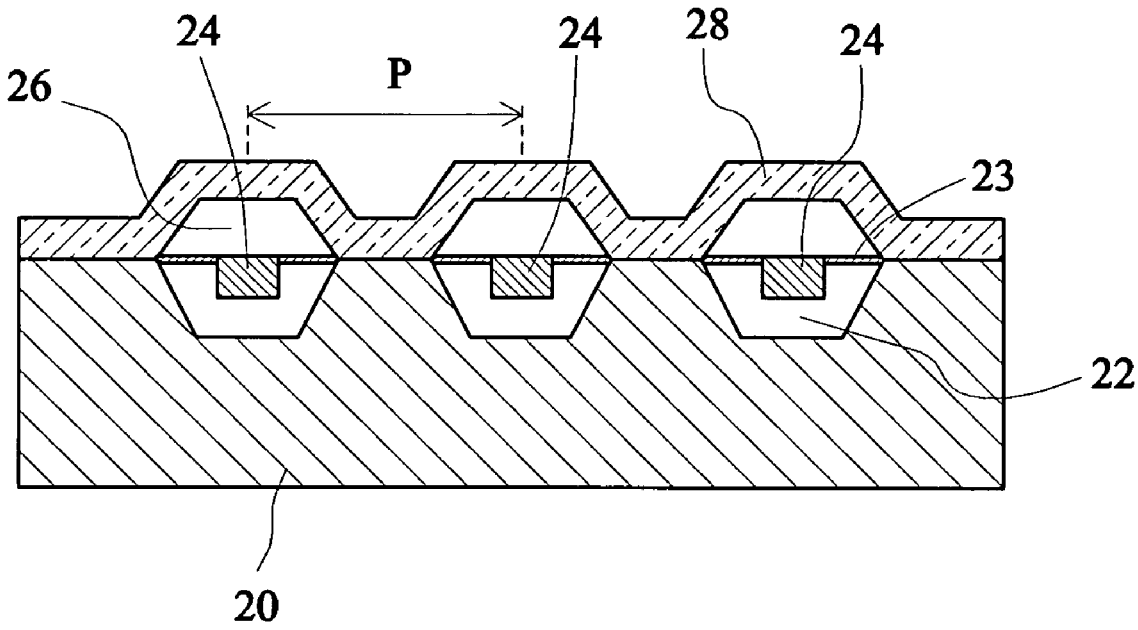
FIG. 7 is a cross-sectional view showing a thermal printing device according to a third embodiment of the invention.

FIG. 7 is a cross-sectional view showing a thermal printing device according to a third embodiment of the invention. Referring to FIG. 7, the thermal printing device includes a substrate 20, microheaters 24, and a covering structure 28. The substrate 20 is formed with a plurality of grooves 22 on its upper surface. Each microheater 24 is suspended above the substrate 20 and located in the corresponding groove 22. The covering structure 28 is formed on the substrate 20 to cover the microheaters 24 with gaps 26 left between the microheaters 24 and the covering structure 28.

The method of the invention for forming the structure of the thermal printing device by way of the micromachining technology will be described in the following with reference to FIG. 7. First, a substrate 20 typically made of the monocrystalline silicon with the orientation of (100) is provided. The silicon substrate 20 has the good heat conductance, and can be formed with integrated circuits. Then, a plurality of grooves 22 is formed on a surface of the substrate 20 by way of silicon anisotropic etching using the TMAH (tetramethylammonium hydroxide) etching solution. Next, a microheater 24, which is a floating bridge structure suspended above each groove 22, is formed, wherein one or a plurality of supports 23 connecting the microheater 24 to the substrate 20 is also formed to support and suspend the microheater 24 above the substrate 20. The microheater 24 may have a sandwich layer structure including, from bottom to top, a dielectric layer, a resistor layer, and a dielectric layer, wherein the material of the dielectric layer is typically the silicon dioxide, silicon nitride or silicon carbide, and the resistor layer is made of polysilicon, metal or other resistor material.

A covering structure 28 for covering the microheaters 24 is formed on the substrate 20 with a gap 26 left between the covering structure 28 and the microheater 24. The covering structure 28 may be a sandwich layer structure including, from bottom to top, a silicon dioxide, a silicon nitride and a silicon carbide. The material property of the covering structure 28 is such that good heat conductivity and wear resistance may be satisfied. The gap 26 may be formed by defining a sacrificial layer and then removing the sacrificial layer. The material of the sacrificial layer is the polysilicon or amorphous silicon, and may be the aluminum metal.

When the thermal printing device of the invention is actually used, the heat generated by the microheaters 24 is mainly conducted to the covering structure 28 via the gap 26 by way of radiation, and the covering structure 28 with the heat energy may serve as print points for thermal printing. Because each of the microheaters 24 is supported by a few supports and suspended above the groove 22 (i.e., only the few supports contact the microheaters 24 and the substrate 20), the solid heat conductivity may be greatly reduced to typically $10^{-5}$~$10^{-6}$ W/° C. Therefore, temperature of the microheater 24 may be increased above 100° C. by only a few milliwatts (mW), and the effects of low power consumption and high heating efficiency may be obtained.

In addition, using the micromachining technology to form the microstructure enables this embodiment to have good heat-isolation effects between adjacent microheaters 24, the pitch P between the adjacent microheaters 24 may be made smaller than 40 microns, and the resolution as high as 600 dpi can be obtained, which cannot be achieved in the prior art.

On the other hand, using the micromachining technology to manufacture the thermal printing device of this embodiment makes it possible to integrate associated circuits on a single chip, so that the manufacturing processes may be simplified, and the size of the product may be miniaturized.

While the invention has been described by way of an example and in terms of a preferred embodiment, it is to be understood that the invention is not limited to the disclosed embodiment. To the contrary, it is intended to cover various modifications. Therefore, the scope of the appended claims should be accorded the broadest interpretation so as to encompass all such modifications.

What is claimed is:

1. A thermal printing device, comprising:

a substrate having a surface formed with a plurality of grooves;

a plurality of microheaters suspended above the grooves, respectively; and a covering structure arranged on the substrate and above the microheaters with a gap left between each of the microheaters and the covering structure.

2. The thermal printing device according to claim 1, wherein a material of the substrate is a monocrystalline silicon.

3. The thermal printing device according to claim 1, wherein the grooves are formed by way of silicon anisotropic etching.

4. The thermal printing device according to claim 1, wherein each of the microheaters has a sandwich layer structure comprising, from bottom to top, a dielectric layer, a resistor layer, and a dielectric layer.

5. The thermal printing device according to claim 4, wherein a material of the dielectric layer is selected from one of the group consisting of a silicon dioxide, a silicon nitride and a silicon carbide.

6. The thermal printing device according to claim 1, wherein the covering structure has a sandwich layer structure comprising, from bottom to top, a silicon dioxide, a silicon nitride and a silicon carbide.

7. The thermal printing device according to claim 1, wherein each of the microheaters is supported by at least one support and suspended above each of the grooves corresponding to each of the microheaters.

8. The thermal printing device according to claim 1, wherein the gap is formed by first defining a sacrificial layer followed by removing the sacrificial layer in a subsequent etching step.

9. A method for manufacturing a thermal printing device, comprising the steps of:

providing a substrate; forming a plurality of grooves on the substrate;

forming a microheater above each of the grooves; and forming a covering structure on the substrate and above the microheaters with a gap left between each of the microheaters and the covering structure, the covering structure covering the microheaters.

10. The method according to claim 9, wherein a material of the substrate is a monocrystalline silicon.

11. The method according to claim 9, wherein the grooves are formed by way of silicon anisotropic etching.

12. The method according to claim 9, wherein each of the microheater has a sandwich layer structure comprising, from bottom to top, a dielectric layer, a resistor layer, and a dielectric layer.

13. The method according to claim 12, wherein a material of the dielectric layer is selected from one of the group consisting of a silicon dioxide, a silicon nitride and a silicon carbide.

14. The method according to claim 9, wherein the covering structure has a sandwich layer structure comprising, from bottom to top, a silicon dioxide, a silicon nitride and a silicon carbide.

15. The method according to claim 9, wherein each of the microheaters is supported by at least one support and suspended above each of the grooves corresponding to each of the microheaters.

16. The method according to claim 9, wherein the gap is formed by first defining a sacrificial layer followed by removing the sacrificial layer in a subsequent etching step.

17. The method according to claim 16, wherein a material of the sacrificial layer is selected from one of the group consisting of a polysilicon, an amorphous silicon and an aluminum metal.

* * * * *